US005201439A

United States Patent [19]

Davies

[11] Patent Number: 5,201,439

[45] Date of Patent: Apr. 13, 1993

[54] APPARATUS FOR HOLDING AND TRANSPORTING PAINT

[76] Inventor: Scott Davies, Citrus Heights, Calif.

[21] Appl. No.: 891,184

[22] Filed: Jun. 1, 1992

[51] Int. Cl.[5] ..... B65D 83/10

[52] U.S. Cl. ..... 220/735; 220/751; 220/736; 206/361; 206/557

[58] Field of Search ..... 220/735, 736, 751; 206/361, 557

[56] References Cited

U.S. PATENT DOCUMENTS

| | | | |
|---|---|---|---|
| D. 193,382 | 8/1962 | Goetz . | |
| D. 205,443 | 8/1966 | Layman . | |
| D. 211,611 | 7/1968 | Lyle et al. . | |
| 1,008,856 | 11/1911 | Mosher | 220/736 |
| 1,748,789 | 2/1930 | Orkin | 220/736 |
| 2,259,927 | 10/1941 | Dunton | 220/736 |
| 2,521,122 | 9/1950 | Lambourne | 220/736 |
| 2,566,877 | 9/1951 | Dunton | 220/736 |

FOREIGN PATENT DOCUMENTS

| | | |
|---|---|---|
| 1093203 | 5/1955 | France . |
| 1352969 | 5/1974 | United Kingdom . |

*Primary Examiner*—Joseph Man-Fu Moy
*Attorney, Agent, or Firm*—Thomas R. Lampe

[57] ABSTRACT

Apparatus for holding and transporting paint includes a front, a bottom, side walls and a back wall. A top element is connected to the side walls and the back wall and is in registry with a portion of the bottom and spaced therefrom to define a receptacle for paint when the apparatus is positioned with the front disposed upwardly relative to the rear wall.

12 Claims, 1 Drawing Sheet

APPARATUS FOR HOLDING AND TRANSPORTING PAINT

TECHNICAL FIELD

This invention relates to apparatus for holding and transporting paint. More particularly, the apparatus is in the general nature of a paint roller tray; however, the apparatus incorporates structure which permits the apparatus to be utilized as a receptacle for paint to facilitate the transport thereof from one location to another.

BACKGROUND ART

Paint roller trays are in common usage by both professional and amateur painters and a number of configurations of such devices have been devised. Examples of paint roller trays are shown, for example, in Design U.S. Pat. No. 205,443, issued Aug. 9, 1966, Design U.S. Pat. No. 193,382, issued Aug. 14, 1962, Design U.S. Pat. No. 211,611, issued Jul. 2, 1968, French Patent No. 1,093,203, issued Nov. 17, 1954, and British Patent Specification No. 1,352,969, published May 15, 1974.

Paint roller trays are conventionally utilized in association with paint rollers. The user pours an amount of paint in the tray and utilizes a paint roller in conjunction therewith. The roller soaks up the paint to a degree and control of the amount of paint in the roller is maintained by rolling the roller onto a tray to squeeze excess paint therefrom.

A number of difficulties are encountered when utilizing conventional prior art paint tray constructions. For example, significant spillage of paint over the walls of the tray often takes place. Furthermore, spillage rather routinely occurs when one attempts to transport the tray containing paint from one location to another.

DISCLOSURE OF INVENTION

The present invention relates to apparatus for holding and transporting paint which is of relatively simple, inexpensive construction. The structural elements of the apparatus cooperate to greatly lessen the chance of spillage both during use and transport of the apparatus, as compared to prior art arrangements.

The apparatus includes a front, a bottom, side walls, and a back wall. The front, the side walls, and the back wall are interconnected and project from the bottom.

A top element or cover is connected to the side walls and the back wall. The top element is in registry with a first portion of the bottom and spaced therefrom.

The top element has an inner surface engageable by a paint roller to remove excess paint from the paint roller. The side walls, top element and the bottom first portion define a receptacle for paint in the apparatus when the apparatus is positioned with the front disposed upwardly relative to the rear wall.

The top element defines a plurality of projections engageable by the paint roller. The back wall is smoothly curved between the bottom and the top element and has a radius of curvature exceeding the radius of curvature of the paint roller utilized with the apparatus, with the bottom and the top element spaced apart a distance exceeding the diameter of the paint roller.

Support means is located at the front of the apparatus for supporting the apparatus with the rear wall generally disposed under the front. The support means may be hand held or utilized to suspend the apparatus from an object such as a ladder rung.

The top element defines a recess for accommodating the shaft of a paint roller and employs lock means for releasably retaining the shaft in the recess.

Other features, advantages, and objects of the present invention will become apparent with reference to the following description and accompanying drawings.

BEST MODE FOR CARRYING OUT THE INVENTION

Figure 1:
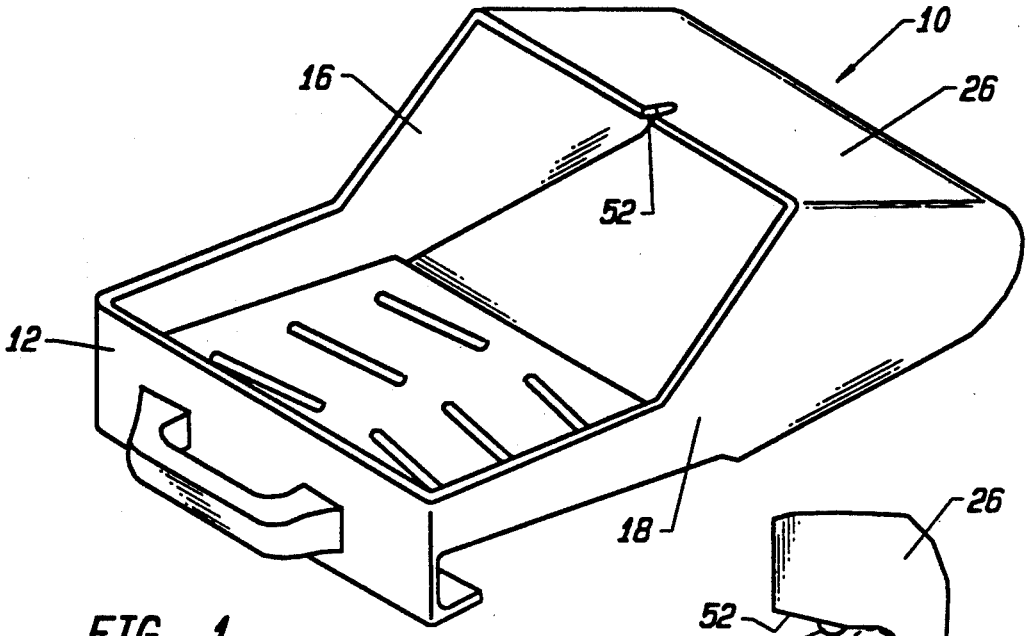
FIG. 1 is a frontal, perspective view illustrating apparatus constructed in accordance with the teachings of the present invention.

Referring now to the drawings, apparatus constructed in accordance with the teachings of the present invention is indicated generally by reference numeral 10. The apparatus 10 includes a front in the form of a front wall 12, a bottom in the form of a bottom wall 14, side walls 16, 18, and a back wall 20. The front wall, side walls, and back wall are interconnected, as shown, and project upwardly from the bottom wall 14 when the apparatus is in conventional position illustrated in FIGS. 1 and 2.

A top element in the form of a top wall 26 is connected to the side walls and the back wall and in registry with a first portion 28 of the bottom wall and spaced therefrom.

Figure 2:
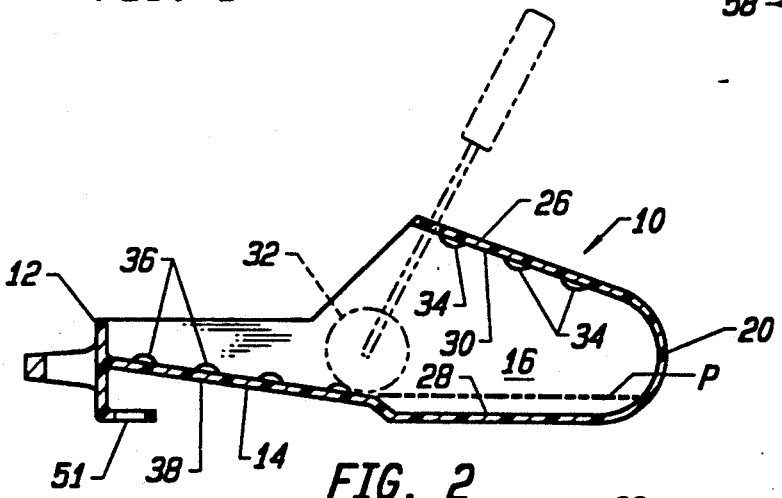
FIG. 2 is a cross-sectional view of the apparatus taken along the line 2—2 in FIG. 3, and illustrating in phantom a paint roller disposed therein.
Figure 3:
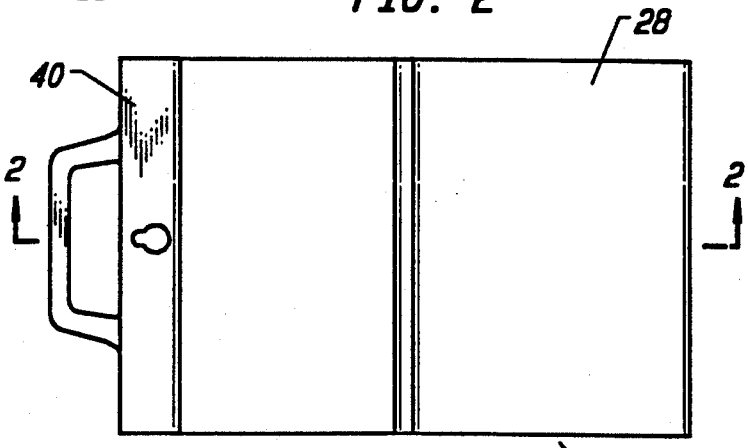
FIG. 3 is a bottom view of the apparatus.

The top element or wall 26 has an inner surface 30 engageable by a paint roller (shown in phantom in FIG. 2 and identified by reference numeral 32). A plurality of projections in the form of elongated ribs 34 project toward the bottom first portion 28. Likewise, projections in the form of ribs 36 project upwardly from the bottom second portion 38. Projections 34, 36 and the walls from which they project are employed to work the paint roller when the roller is in engagement therewith to squeeze excess paint from the roller and provide for relatively uniform distribution of paint about the periphery of the roller. Also, of course, the projections provide improved traction for the roller. The second portion 38 is offset from the bottom first portion 28 and has an upper surface inclined toward the first portion whereby paint will flow under the influence of gravity from the second portion toward the first portion when the apparatus is located upon a support surface (not shown) in the position illustrated in FIGS. 1 and 2. The term "paint" as employed herein encompasses any fluid or semi-fluid material which may be applied by a paint roller, e.g., stains.

Back wall 20 is smoothly curved between the bottom 14 and top element 26. The smoothly curved back wall 20 has a radius of curvature exceeding the radius of curvature of the paint roller and the bottom 14 and top element or wall 26 are spaced apart a distance exceeding the diameter of the paint roller. Thus, when paint is disposed over bottom first portion 28 as designated by the letter P in FIG. 2, the painter may readily manipulate the paint roller by means of its handle to first absorb paint P and then roll the roller in engagement with curved back wall 20 and up and along top wall 26 to remove excess paint therefrom. This will be accomplished without spilling since the side walls 16, 18 extend between the bottom and top walls. Of course, the painter may also roll the paint roller in engagement with bottom second portion 38 and projections 36 in a conventional manner. However, since the side walls are not as high toward the front of the apparatus, spillage is more likely.

Figure 5:
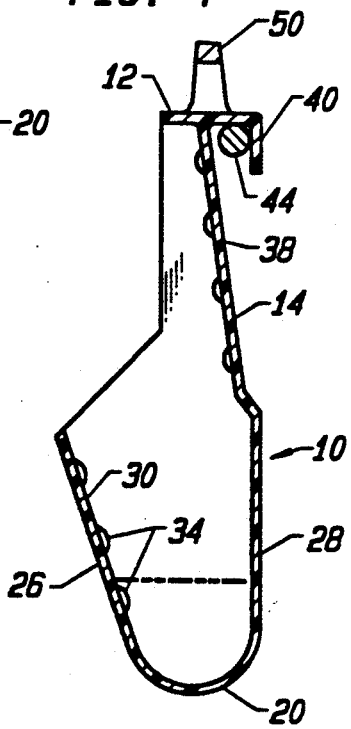
FIG. 5 is a cross-sectional view somewhat similar to FIG. 2, but illustrating the apparatus being suspended from an object by a support element incorporated in the apparatus.

Support means is provided to enable the apparatus to be suspended in the position illustrated in FIG. 5. In such figure, it may be seen that a support element in the form of a flange 40 extends from front wall 12 in partial registry with bottom wall second portion 38. This allows the apparatus to be supported from an object such as ladder rung 44. Also, of course, the flange 40 and immediately adjacent portion of front wall 12 can be used as a handle so that the apparatus can be carried by hand in the orientation shown in FIG. 5. The illustrated embodiment of the invention also shows a more conventional handle 50 for receiving the hand of the person transporting the apparatus. A hole 51 (FIG. 2) is formed in flange 40 to allow support of the apparatus by a nail or the like during either use or storage.

It should be noted that the apparatus 10 can be employed in association with a paint roller when the apparatus is in the orientation of FIG. 5 as well as that depicted in FIGS. 1 and 2. When the apparatus is vertically disposed as shown in FIG. 5, paint squeezed from the roller by either top wall 26 or the bottom wall 14 will drip downwardly toward the back wall 20 and then remain within the receptacle defined by the apparatus. The fact that the top element or wall 26 diverges away from the bottom as the top wall progresses toward the front of the apparatus reduces the chances of spillage.

Figure 4:
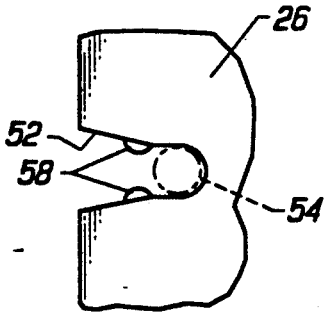
FIG. 4 is an enlarged, partial view illustrating a recess and lock means defined by the top element of the apparatus.

Top element or wall 26 defines a recess 52 for accommodating the shaft of a paint roller when the paint roller is not in use. The shaft is denoted in FIG. 4 by reference numeral 54. Detents 58 project into the recess and act as lock means for releasably retaining the shaft in the recess, it being assumed of course that there is sufficient flexibility in the detents and/or top element 26 to permit passage of the shaft 40 between the detents when sufficient manual force is applied.

Apparatus 10 may be constructed of any suitable material such as plastic. In the arrangement illustrated apparatus 10 is of unitary construction; however, it is to be understood that the apparatus may be of a suitable non-unitary construction.

I claim:

1. Apparatus for holding and transporting paint, said apparatus including a front, a bottom, side walls, and a back wall, said front, said side walls, and said back wall being interconnected and projecting from said bottom, a top element connected to said side walls and said back wall and in registry with a first portion of said bottom and spaced therefrom, said top element having an inner surface engageable by a paint roller having a predetermined diameter and radius of curvature to remove excess paint from said paint roller, and said side walls, top element and said bottom first portion defining a receptacle for paint in said apparatus when said apparatus is positioned with said apparatus front disposed upwardly relative to said rear wall, said back wall being smoothly curved between said bottom and said top element and having a radius of curvature exceeding the radius of curvature of a paint roller, and said bottom and top element being spaced apart a distance exceeding the diameter of a paint roller.

2. The apparatus according to claim 1 wherein said top element defines a plurality of projections engageable by a paint roller.

3. The apparatus according to claim 1 wherein support means is located at the front of said apparatus for supporting said apparatus with said rear wall generally disposed under said front.

4. The apparatus according to claim 3 wherein said apparatus front is defined by a front wall connected to said side walls and spaced from said rear wall, said support means including a support element connected to said front wall.

5. The apparatus according to claim 4 wherein said support element extends from said front wall and is spaced from said bottom wall.

6. The apparatus according to claim 1 wherein said top element defines a recess for accommodating the shaft of a paint roller.

7. The apparatus according to claim 6 additionally comprising lock means for releasably retaining the shaft of a paint roller in said recess.

8. The apparatus according to claim 1 wherein said bottom includes a second portion offset from said first portion, said second portion having an upper surface inclined toward said first portion whereby paint will flow under the influence of gravity from said second portion toward said first portion.

9. The apparatus according to claim 8 wherein said second portion defines a plurality of projections on said upper surface.

10. The apparatus according to claim 1 wherein said apparatus is of unitary construction.

11. The apparatus according to claim 1 wherein said top element diverges away for said bottom as said top element progresses toward the front of said apparatus.

12. The apparatus according to claim 2 wherein said projections are spaced ribs projecting in the direction of said bottom.

* * * * *